US005861062A

United States Patent [19]

Reiss

[11] Patent Number: 5,861,062

[45] Date of Patent: Jan. 19, 1999

[54] WORKPIECE SPRAY-PAINTING DEVICE

[75] Inventor: Herbert Reiss, Krauchenwies, Germany

[73] Assignee: Tegometall (International) AG, Taegerwilen, Switzerland

[21] Appl. No.: 776,523

[22] PCT Filed: Jun. 14, 1996

[86] PCT No.: PCT/DE96/01055

§ 371 Date: Feb. 27, 1997

§ 102(e) Date: Feb. 27, 1997

[87] PCT Pub. No.: WO97/01395

PCT Pub. Date: Jan. 16, 1997

[30] Foreign Application Priority Data

Jun. 27, 1995 [DE] Germany ..... 195 23 319.0

[51] Int. Cl.[6] ..... B05B 1/28

[52] U.S. Cl. ..... 118/326; 118/309; 55/DIG. 46; 454/50

[58] Field of Search ..... 118/326, 300, 118/309; 454/50, 53, 55, 63; 55/DIG. 46

[56] References Cited

U.S. PATENT DOCUMENTS

| | | | |
|---|---|---|---|
| 4,640,220 | 2/1987 | Fallas | 118/326 |
| 4,715,314 | 12/1987 | Ramseier et al. | 118/326 |
| 4,932,316 | 6/1990 | Josefsson | 454/50 |

FOREIGN PATENT DOCUMENTS

| | | |
|---|---|---|
| 92 45 934 | 5/1980 | Germany . |
| 30 14 114 | 11/1981 | Germany . |
| 31 31 565 | 12/1984 | Germany . |
| 36 02 172 | 12/1986 | Germany . |
| 36 40 699 | 8/1988 | Germany . |
| 38 38 927 | 5/1990 | Germany . |
| 41 16 897 | 11/1992 | Germany . |
| 41 26 891 | 2/1993 | Germany . |

*Primary Examiner*—David A. Simmons
*Assistant Examiner*—Calvin Padgett
*Attorney, Agent, or Firm*—Foley & Lardner

[57] ABSTRACT

A workpiece spray-painting device having at least two painting booths arranged on the conveying track of the workpieces, with each booth being designed in two separate parts that may be separated from each other. A spraying device for coating the workpieces is movable on a track between the booths when the booth parts are separated from each other so that the spray device may be positioned in one or the other of the booths.

11 Claims, 2 Drawing Sheets

WORKPIECE SPRAY-PAINTING DEVICE

This application is a 371 of PCT/DE96/01055 filed Jun. 14, 1996.

BACKGROUND OF INVENTION

The invention relates to an appliance for the spray coating of workpieces with paint, which has at least two coating booths, arrange on a conveying track for the workpieces, and a spray device. Such a spray-coating appliance is suitable particularly for electrostatic powder coating.

The principle of electrostatic powder coating is employed primarily for the lacquering of sheet-metal and finished parts, since it is particularly economical and environmentally friendly. Furthermore, high throughput quantities of material to be lacquered can be achieved with powder-coating systems.

In conventional powder-coating systems, however, as in lacquering systems working according to other paint-coating methods, problems arise when the colour is changed. In particular, in order to achieve a homogeneous and uniform coating along with a high throughput of material to be lacquered, a concentrated paint-powder jet is directed onto the workpiece to be lacquered, but only some of the paint powder adheres to the workpiece, whereas the remaining paint powder settles in the system.

The known coating systems therefore have a suction-extraction device., in order to return the paint-powder excess into the paint-powder circuit. However, paint-powder particles always remain adhering particularly to the coating-booth walls and, in the event of a change of colour, cause colour mixing and consequently an impurity. In order to avoid this, the coating booth has to be cleaned whenever the colour is changed. This therefore always gives rise to costly standstill times in the coating system.

Moreover, particularly in an electrostatic powder-coating system, a relatively great amount of time is needed for cleaning during a colour change, since the paint-powder particles, by virtue of their electrical charge, often adhere firmly to the coating booths.

In order to allow a rapid colour change in powder-coating systems, powder-coating systems possessing a plurality of coating booths for different colours, so that one booth can always be cleaned alternately for the colour change, are already being used. CH 668 008 A5 describes such a powder-coating system having two coating booths which are arranged parallel to one another and are supplied by means of a switch via a common conveying track. However, this system is very costly, since two complete coating booths, each provided with a spray device, are necessary.

SUMMARY OF THE INVENTION

The object of the invention is, therefore, to provide a cost-effective appliance for the spray coating of workpieces, which allows a rapid colour change.

In the spray coating appliance according to the invention, at least two coating booths are arranged on the conveying track for the workpieces and are designed in two parts, the booth parts being separable from one another, so that the spray device can be transferred between the coating booths.

In the spray-coating appliance according to the invention, the standstill times during the colour change can be reduced substantially, since, by virtue of the two-part design of the coating booths, the spray device can be transferred simply and quickly between the coating booths having the different paints. In this case, the cleaning of the spray device consisting of a spray-gun arrangement can be carried out easily by blowing it clear by means of compressed air. Use of only one spray device for both coating booths further substantially reduces the production costs in comparison with a system having two completely equipped coating booths.

According to a preferred embodiment of the invention, the booth parts can be moved apart from one another transversely relative to the conveying track for the workpieces. The coating booth is thus accessible in a simple way and can be cleaned quickly and effectively.

According to a preferred embodiment of the invention, the coating booths are designed cylindrically. This leads to a further substantial reduction in the cleaning times during the colour change, since corners and edges, from which paint deposits can be removed only with great difficulty, are avoided as a result of the cylindrical design of the booth inner walls. This advantageous design of the booth inner walls can also be adopted, irrespective of the double-booths design according to the invention, in conventional spray-coating appliances for the purpose of improving the cleaning facility.

Furthermore, according to an advantageous embodiment, the spray device is arranged movably on a running rail located between the coating booths, an additional cleaning device being provided for the spray device on the running-rail track. By means of this cleaning device, possible paint deposits on the spray device which, particularly in the case of an extreme colour change, for example from black to white, may lead to impurity on the material to be lacquered, can be removed easily and quickly.

According to a further advantageous embodiment of the invention, a suction-extraction device is embedded centrally in the floor of the coating booth, whilst the booth floor can additionally be made funnel-shaped and be provided with a ventilated fluid plate. The arrangement of the suction-extraction device in the booth floor underneath the workpiece makes it possible, on the one hand, to achieve an improvement in the application efficiency, since the paint powder discharged by the spray device is retained for longer in the vicinity of the material to be lacquered. Furthermore, as a consequence of this arrangement of the suction-extraction device, a coating booth with an extremely small standing surface can be produced. Furthermore, the additionally funnel-shaped design of the booth floor and the mounting of a ventilated fluid plate allow effective suction extraction of the paint-powder excess during the coating operation. Paint-powder deposits on the booth walls are therefore largely prevented, thus appreciably simplifying the cleaning of the coating booths.

Moreover, an interior cleaning system, often used in conventional systems and intended for detaching the paint powder from the inner wall of the coating booths, can therefore also be dispensed with. A suction-extraction device described can also advantageously be employed, irrespective of the double-booths design according to the invention, in the spray-coating appliances which are already known.

According to a further advantageous embodiment of the invention, the spray device consists of at least two rows of spray guns which are arranged vertically one above the other and which are located opposite one another in the coating booths on both sides of the conveying track for the workpieces. As a result of this design of the spray device, a stable and largely uniform paint-powder cloud can be formed in the region of the material to be lacquered, thus leading to a marked improvement in the application efficiency.

Moreover, a largely uniform application of the paint powder on the material to be lacquered is also guaranteed in regions of problem zones, such as, for example, corners and edges.

Furthermore, the arrangement in vertically placed rows located opposite one another ensues an appreciable lowering of the operating costs, since the paint-powder loss can be reduced substantially on account of the formation of a powder cloud. Also, fewer spray guns are required in comparison with conventional spray devices, thus reducing both the purchase costs and the maintenance costs. This spray device can also be employed advantageously in conventional coating appliances, irrespective of the spray-coating appliance according to the invention having a double booth.

According to a further advantageous embodiment of the abovementioned spray device, two rows of spray guns arranged vertically one above the other are mounted in the coating booth on both sides of the conveying track, the spacing between the spray-gun rows located opposite one another being different. The advantage of this design of the spray device is that problem locations on the material to be lacquered can be coated by the spray-gun rows lying close together, while surface covering can be carried out by means of the more widely spaced rows which, moreover, can have special spray-gun nozzles.

In addition, the spray device can also be coupled to a lifting device, in order thereby to achieved optimum layer thickness distribution, particularly on smooth surfaces of the material to be lacquered.

BRIEF DESCRIPTION OF THE APPLICATION DRAWINGS

A preferred exemplary embodiment of the invention is described below with reference to the application drawings in which FIG. 1 shows a top view of the coating appliance according to the invention, and FIG. 2 shows a view of the coating booth of the coating appliance according to the invention along the sectional line I—I in FIG. 1.

DESCRIPTION OF THE PREFERRED EMBODIMENT

Figure 1:
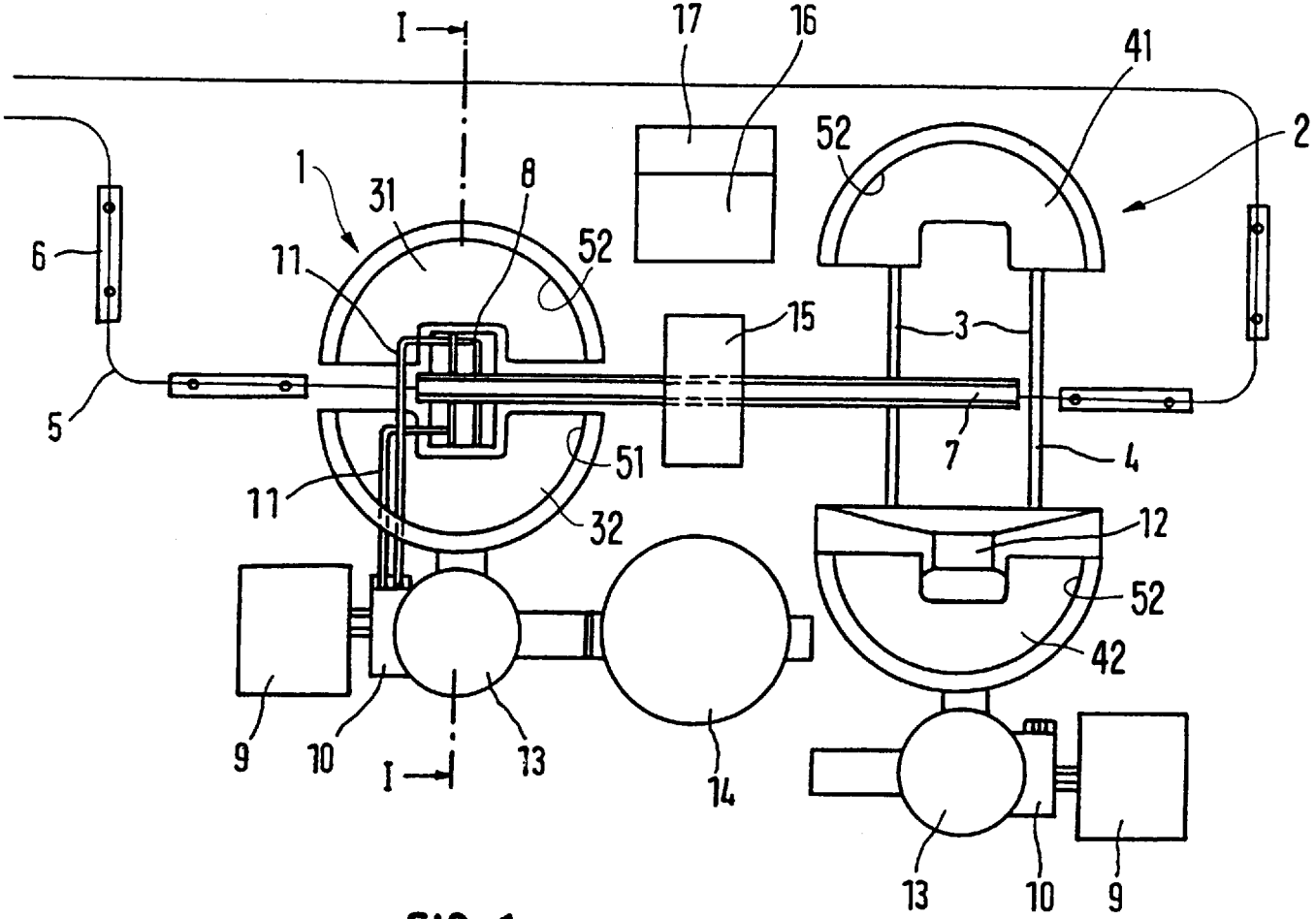

The spray-coating appliance according to the invention, represented in FIG. 1, has two coating booths 1 and 2 arranged on a conveying track 5. Each coating booth 1, 2 consists of two essentially symmetrical booth halves 31, 32 and 41, 42, respectively which are arranged on either side of the conveying track 5. The side walls of the coating booths are designed as cylindrical surfaces, the coating booths possessing an essentially circular base in the closed state. The cylindrical design of the inner walls 51, 52 of the coating booths 1, 2, respectively makes it easier to detach paint-powder deposits, since corners and edges where access is difficult are largely avoided.

The two booth parts of the coating booths are displaceable along two running rails 3 which are located under the coating booth and which are preferably arranged perpendicularly to the conveying track. In the representation shown in FIG. 1, the two parts 41, 42 of the coating booth 2 are drawn apart from one another along these running rails 3 transversely relative to the conveying track, so that cleaning of these booths for a colour change can be carried out.

Furthermore, located between the coating booths 1 and 2 is a running rail 7, on which a spray device 8, shown in the coating booth 1 which is in operation, is arranged movably.

Each coating booth, moreover, possesses a paint-powder storage container 9 and a paint-powder metering device 10 connected to the latter. The metering devices 10 have in each case connections, to which the powder supply 11 connected to the spray device 8 can be releasably connected, as shown in the coating booth 1 which is in operation.

Furthermore, in each coating booth there is provided a suction-extraction device 12 which is embedded in the booth floor and which is connected to a powder recovery system 13. By means of this device 13 working, for example, on the cyclone principle, the paint powder suction-extracted from the coating booth can be filtered out of the spent air of the coating booth.

Moreover, the powder recovery device 13 is connected in each case to the powder storage container 9, in order to return the recovered paint powder into the paint-powder circuit. The powder recovery devices 13 coupled to the coating booths 1 and 2 can in each case be releasably coupled to a final filter system 14 which is located between the cooting booths, as shown in the coating booth 1 which is in operation. The final filter system 14 serves for cleaning the spent air suction-extracted from the coating booth.

To clean the spray device 8, a cleaning device 15 is additionally provided between the coating booths 1, 2, by means of which cleaning device any paint deposits on the spray device 8 can be removed automatically, for example by means of granulate.

Furthermore, the spray-coating appliance has a control device 17 for the fully automatic regulation of the entire coating operation including the colour change. This control device is connected to a fire suppression system 16, in order to extinguish fires in the paint powder.

Figure 2:
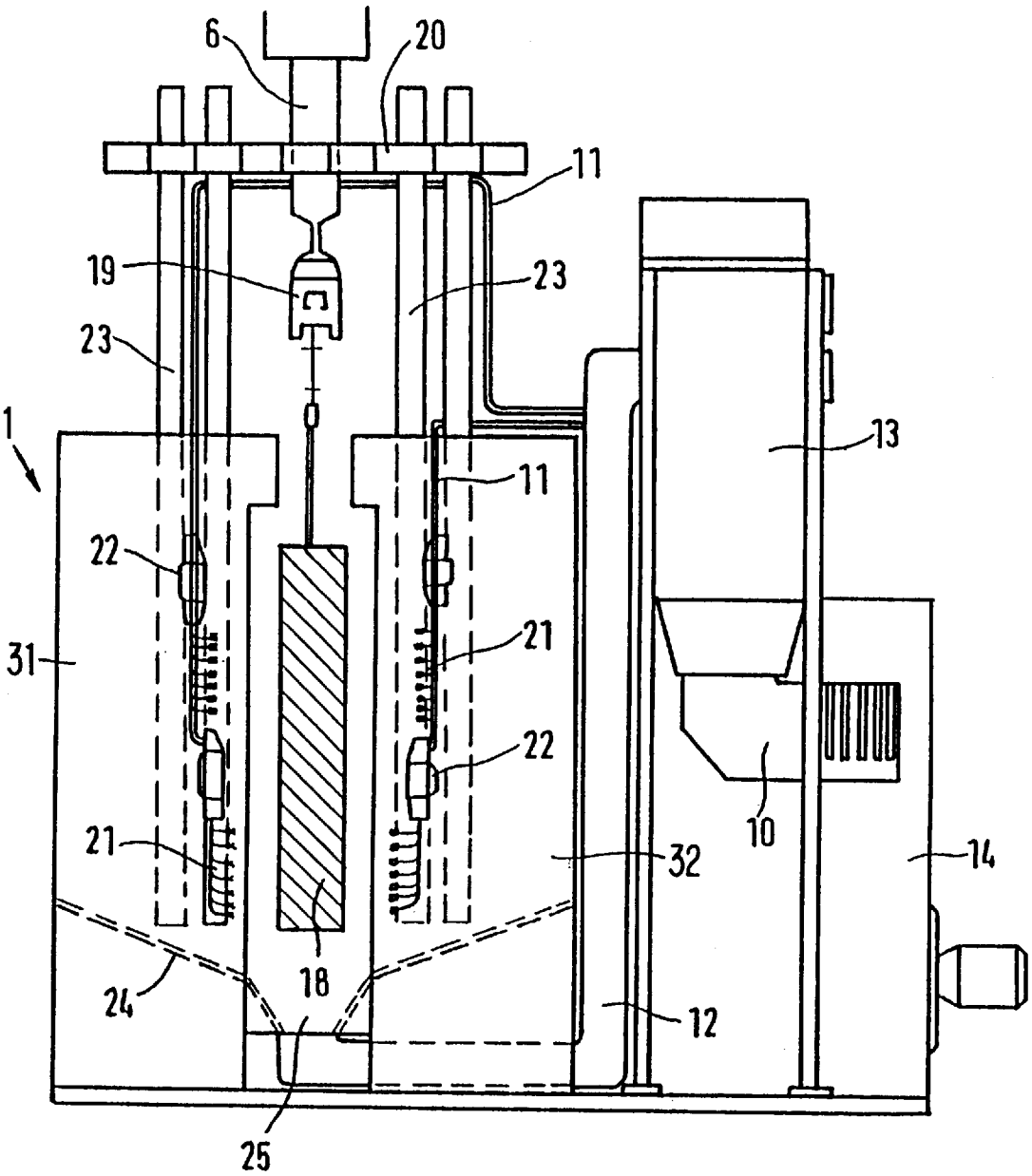

FIG. 2 shows a cross-section through the coating booth 1 which is in operation. An orifice 25 of the suction-extraction device 12 is embedded centrally in the booth floor directly underneath the workpiece to be lacquered. The booth floor is made funnel-shaped in respect of this suction-extraction orifice 25, in order to allow simple suction-extraction of the paint-powder excess precipitated in the coating booth.

Furthermore, the booth floor is provided with a fluid plate 24 operated by means of compressed air, the compressed air on the fluid plate generating a floating paint-powder particle stream moving in the direction of the orifice 25 of the suction-extraction device 12. The above-described design of the paint-powder suction-extraction device allows effective suction extraction of the paint-powder excess, while largely avoiding deposits on the coating-booth walls.

The spray device 8 for the paint powder has four rows of vertically guided spray guns 21 which are designed, in particular, as tribo-guns, two rows always being located opposite one another in each case, in order to generate a stable and homogeneous paint-powder cloud on the workpiece 18. The spacing between the first two rows of spray guns 21 is selected smaller than the spacing between the second two rows.

The more widely spaced spray guns 21 have nozzles generating highly fanned-out spray jets and serve primarily for covering the large-area workpiece parts. In contrast, the spray-gun rows lying more closely together ensure, with their lower fanning-out of the spray jet, in particular a reliable spraying of problem locations on the workpiece, for example grooves and bends, or locations where access is difficult in deep workpieces.

The spray-gun rows are arranged movably on a stand 23 in each case by means of a spray-gun holding device 22. Furthermore, the stands 23 are connected to a lifting device 20 which ensures an oscillating lifting movement of the stands and consequently of the spray-gun rows. The oscillating movement of the spray device 8 guarantees a uniform layer thickness distribution of the paint powder on the workpiece 18.

The supply of paint powder to the spray guns 21 takes place vertically from above via the paint-powder supply 11. This design of the paint-powder supply prevents a paint-powder column from occurring in the spray guns 21 during the start-up of the coating booth, which paint-powder column would be established on account of the dead weight of the powder particles in the case of a paint-powder supply from below.

Arranged along the conveying track 5 are overhead trolleys 6 which have a suspension 19 for fastening the workpiece 18 to be lacquered. As soon as an overhead trolley 6 having a workpiece to be lacquered moves into the coating booth which is in operation, the spray device 8 commences the spraying operation. The paint-powder particles fed from the paint-powder storage container 9 via the powder-metering device 10 and the powder supply 11 into the spray device 8 are charged electrically in the spray guns 21 and are ejected via the nozzles on the spray guns. As a result of the arrangement of vertical spray-gun rows on both sides of the conveying track, a stationary paint-powder cloud is generated on the workpiece, thus ensuring high application efficiency. The use of a plurality of differently spaced spray-gun rows with different nozzle sets makes it possible, furthermore, to ensure a uniform coating both of large-area workpiece parts and of corners and edges.

According to an advantageous execution of the spraying operation, first a large-area covering of the workpiece to be lacquered is carried out by means of the more widely spaced spray-gun rows which generate a broadly fanned-out spray jet and subsequently a covering of problem zones is carried out by means of the spray-gun rows lying more closely together and having more sharply directed spray jets.

In the exemplary embodiment shown in FIG. 2, the spray-gun rows are displaceable along the stands 23 by means of the spray-gun holding devices 22, so that even wide workpieces can be coated completely. In this case, the workpiece is moved past the spray-gun rows, for example, at a conveyor speed of 6 m/min. However, it is also possible to provide additionally a spray-gun follow-up device which runs synchronously with the overhead trolley. Lacquering outputs of 800 $m^2$/h can be achieved by means of the coating appliance according to the invention.

The paint-powder excess not adhering to the workpiece is suction-extracted downwards by means of the suction-extraction device 12 arranged underneath the workpiece. The fluid plate 24 located on the booth floor and operated by compressed air generates a floating paint-powder particle stream in the direction of the orifice 25 of the suction-extraction device 12, via which the paint powder, together with the spent air, is guided into the powder recovery device 13. In the powder recovery device 13, the paint powder is filtered out and returned into the paint-powder circuit. Suction-extraction capacities of up to 8,000 $m^3$/h can be produced by means of the suction-extraction device 12 shown in the exemplary embodiment.

When a colour change from a first colour to a second is provided in the spray-coating appliance, the paint-powder supply for the spray device 8 is interrupted. The powder supply 11 and the spray device 8 are then blown clear of paint deposits of the first colour by means of pulsating compressed air. Subsequently, the powder supply 11 is uncoupled from the powder-metering device 10 for the first colour and the two booth parts of the coating appliance are moved apart from one another. The spray device is then moved along the running rail into the coating booth loaded with the second colour. If an extreme colour change, for example from dark brown to white, is envisaged, an additional cleaning step for the spray device 8 is carried out in the cleaning device 15 arranged on the running rail.

After the spray device 8 has moved into the coating booth for the second colour, the latter is closed and the powder supply 11 is coupled to the powder-metering device 10 for the second colour. The colour-changing operation can be controlled automatically by means of the control device 17 in the same way as the spraying operation.

I claim:

1. Workpiece spray-painting device for spray coating of workpieces conveyed on a conveying track, comprising:

at least two coating booths arranged on a conveying path of the conveying track, wherein each coating booth has two outer booth parts arranged one on each side of the conveying track;

rails associated with each coating booth for enabling the outer booth parts of each coating booth to be movable apart from each other transversely relative to the conveying track;

a spray device for coating the workpieces with paint, the spray device being movably arranged; and a running rail for guiding the spray device between the coating booths when the outer booth parts of each coating booth are moved apart from each other, whereby workpieces in either of the coating booths can be alternatively spray painted.

2. The device according to claim 1, wherein the running rail is located between the coating booths along the conveying path of the conveying track.

3. The device according to claim 1, wherein the coating booths are formed with substantially cylindrical inner walls.

4. The device according to claim 1, further including a cleaning device for cleaning the spray device arranged between the coating booths along the conveying path of the conveying track.

5. The device according to claim 1, wherein each coating booth includes a suction-extraction device arranged centrally on a floor thereof and wherein the paint is in powder form.

6. The device according to claim 5, wherein the floor of the coating booth is funnel-shaped.

7. The device according to claim 5, wherein each coating booth includes a ventilated fluid plate arranged on the floor thereof around the suction-extraction device.

8. The device according to claim 1, wherein the spray device has at least two rows of spray guns, the spray guns in each row being arranged vertically one above the other, the two rows being located opposite to one another, with one row on each side of the workpieces.

9. The device according to claim 8, wherein the spray device has two additional rows of spray guns, the spray guns on each additional row being arranged vertically one above the other, the two additional rows being located opposite to one another, with one additional row on each side of the workpieces at a greater spacing than the other rows of spray guns.

10. The device according to claim 8, wherein the spray device is connected to a lifting device.

11. The device according to claim 8, the spray device further includes conduits communicating with a paint-powder supply arranged above the spray guns.

* * * * *